US005934269A

United States Patent [19]

Wilson

[11] Patent Number: 5,934,269

[45] Date of Patent: Aug. 10, 1999

[54] FLEXIBLE FUEL TUBE ASSEMBLY FOR GAS-FIRED APPLIANCE AND INSTALLATION METHOD

[75] Inventor: Lawrence G. Wilson, Howell, Mich.

[73] Assignee: Tru-Flex Metal Hose Corporation, West Lebanon, Ind.

[21] Appl. No.: 09/049,596

[22] Filed: Mar. 27, 1998

[51] Int. Cl.[6] ..... F23C 1/18; F24C 3/00

[52] U.S. Cl. ..... 126/512; 126/500; 126/42; 285/354; 285/903

[58] Field of Search ..... 126/512, 500, 126/503, 25 B, 42; 431/125; 285/354, 339, 255, 249, 247, 905, 903

[56] References Cited

U.S. PATENT DOCUMENTS

| | | | |
|---|---|---|---|
| 3,042,109 | 7/1962 | Peterson | 126/512 |
| 3,437,357 | 4/1969 | Rubin | 285/249 |
| 4,891,005 | 1/1990 | Carter | 126/512 |
| 5,169,180 | 12/1992 | Villoni et al. | 285/354 |
| 5,400,766 | 3/1995 | Dillon | 126/42 |
| 5,538,294 | 7/1996 | Thomas | 285/903 |
| 5,647,340 | 7/1997 | Shimek et al. | 126/512 |
| 5,725,259 | 3/1998 | Dials | 285/354 |
| 5,795,144 | 8/1998 | Tung | 126/512 |

FOREIGN PATENT DOCUMENTS 3-233213 10/1991 Japan .

*Primary Examiner*—Ira S. Lazarus
*Assistant Examiner*—Josiah Cocks
*Attorney, Agent, or Firm*—Mark E. Brown; Litman, Kraai & Brown LLC

[57] ABSTRACT

A fuel tube assembly for gas-fired appliances includes a tube with first and second end sections and a corrugated medial section extending therebetween. The end sections are connected to components, such as a gas valve and a burner, by compression fitting subassemblies. The tube assembly can be installed to accommodate various configurations of gas flow paths between the components.

6 Claims, 4 Drawing Sheets

FLEXIBLE FUEL TUBE ASSEMBLY FOR GAS-FIRED APPLIANCE AND INSTALLATION METHOD

BACKGROUND OF THE INVENTION

1. Field of the Invention

The present invention relates generally to flexible tubing, and in particular to a flexible fuel tube assembly for gas-fired appliances.

2. Description of the Prior Art

Gas-fired appliances include ovens, stoves, ranges, clothes dryers, water heaters, furnaces, gas log fireplaces and the like. Such appliances are typically connected to external fuel sources, for example, natural gas lines.

A common type of gas fireplace includes a gas valve connected to the external fuel source and, via an internal fuel tube, to an internal gas burner. An important design consideration is to provide relatively secure and permanent connections between the internal fuel tube and the components attached thereto in order to avoid gas leaks and the hazards associated therewith. Fuel tubes are often constructed of aluminum, stainless steel and other materials chosen for their resistance to rust and corrosion.

Internal fuel tubes in gas-fired appliances often include bends and turns for directing the flow path of gas between desired locations. They can be fabricated from rigid, smooth-walled tubing on pipe-bending equipment specifically designed for this purpose. However, the tubing can kink, collapse or otherwise sustain damage in the bending process, thus wasting material, adding cost and compromising the integrity of the fuel tube and the safety of the appliance.

Another objective in designing gas-fired appliances is to minimize the number of fittings and connections. Fewer fittings can result in lower costs and less risk of leaks.

A common gas flow path configuration in a fireplace exits a gas valve through a bend of approximately 90° to an elbow connector through which the gas flow makes another 90° turn into a burner. Replacing the gas valve and/or the gas burner in such an appliance normally involves removing the internal fuel tube. The fuel tube is often replaced along with the other components, which may necessitate forming the required bend or bends in order to properly align the fuel tube ends with the gas valve and the elbow connector. Fuel tubing can be wasted if the bends are made improperly or if the pipe ends do not properly align with the components to which they are connected.

Problems can also arise in reinstalling an existing internal fuel tube if the replacement components to not align in the same way as the original components being replaced. Variations in component spacing and alignment often require the fuel tube to be custom fabricated for a particular application in the field, with the attendant risks of material waste and misalignment, which could result in leaks.

Heretofore there has not been available a flexible fuel tube assembly for gas-fired appliances with the advantages and features of the present invention.

SUMMARY OF THE INVENTION

In the practice of the present invention, a flexible fuel tube assembly is provided for a gas-fired appliance, such as a gas log fireplace. The fuel tube assembly is installed internally between a gas valve and a burner. The tube assembly includes a tube with opposite, rigid, smooth-walled first and second end sections and a corrugated medial section placed therebetween. The corrugated medial section includes a bend for directing the gas flow along a desired flow path. First and second compression fitting subassemblies are mounted on first and second ends of the tube for connection to the gas valve and the burner. An installation method is also provided.

OBJECTS AND ADVANTAGES OF THE INVENTION

The principle objects and advantages of the present invention include: providing a flexible fuel tube assembly for gas-fired appliances; providing such a tube assembly which can be bent in the field to accommodate a desired gas flow path; providing such a tube assembly which is applicable to a number of different spacings and orientations of components connected by same; providing such a tube assembly which can be formed with conventional tube manufacturing equipment; providing such a tube assembly which is resistant to rust and corrosion; providing such a tube assembly which utilizes readily available compression fitting subassemblies; providing such a tube assembly which reduces material waste; providing such a tube assembly which is adaptable for both original equipment and retrofit applications in gas-fired appliances; providing such a tube assembly which eliminates the fabrication steps of cutting and bending rigid tubing in the field; providing such a tube assembly which particularly well adapted for internal fuel line use in gas log fireplaces; providing a method of fuel line installation in a gas fireplace; and providing such a tube assembly which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
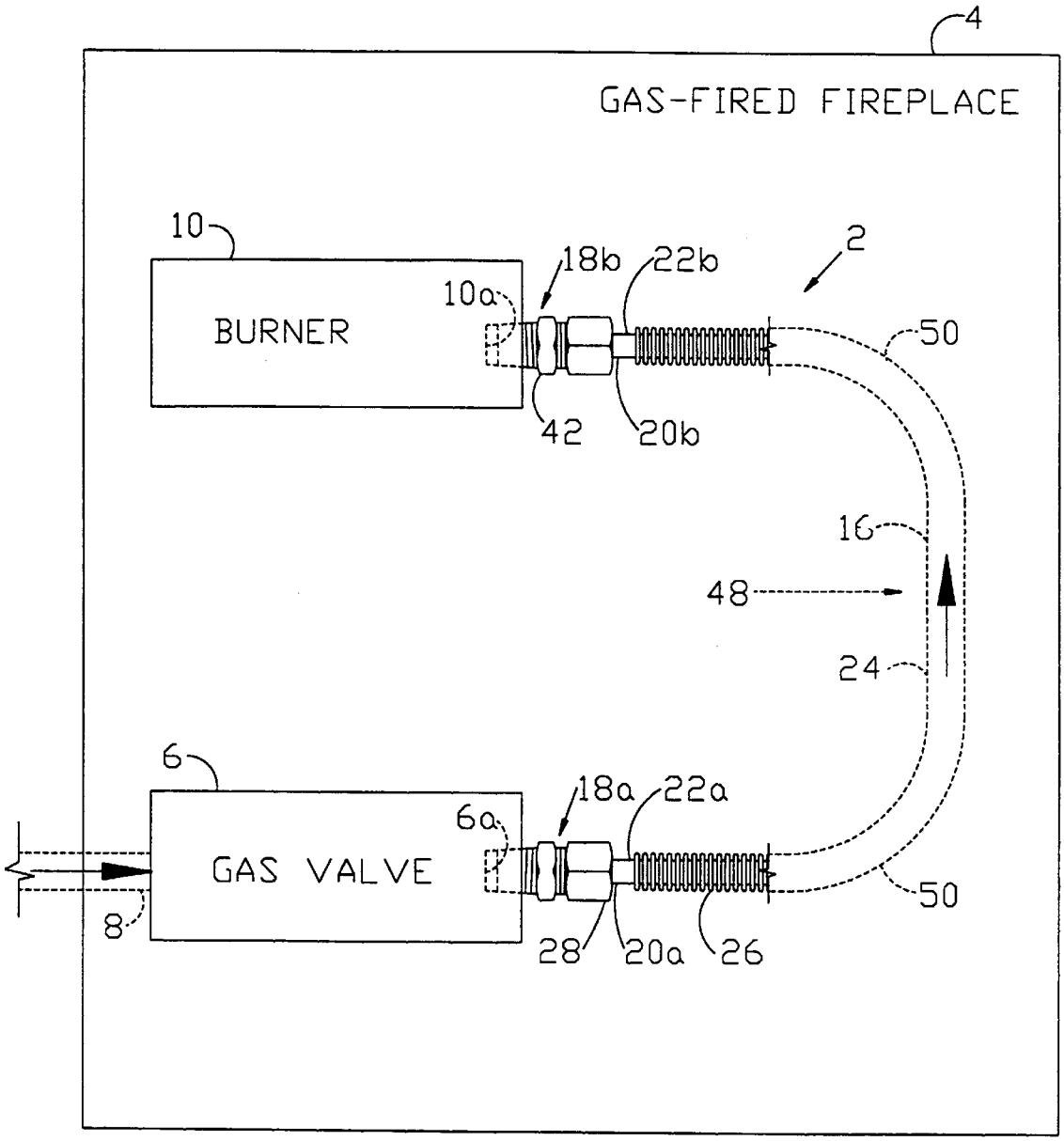
FIG. 1 is a diagram of a gas-fired appliance with an internal, flexible, fuel tube assembly embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a tube assembly embodying the present invention. Without limitation of the generality of useful applications of the tube assembly 2, it is shown installed in a gas-fired appliance 4, such as a fireplace including a valve 6 in a gas supply line 8. An exemplary application of the tube assembly 2 is internal to the appliance 4 for connecting the valve 6 thereof to a burner 10. Similar applications for the tube assembly 2 could be found in other gas-fired appliances.

The appliance valve 6 includes a female-threaded outlet port 6*a* and the burner 10 includes a similarly female-threaded inlet port 10*a*. As shown in FIG. 1, the ports 6*a*, 10*a* are oriented in approximately the same direction whereby the gas flow path must be run through bends or turns of approximately 180° in order to flow from the valve outlet port 6*a* to the burner inlet port 10*a*.

Figure 1A:
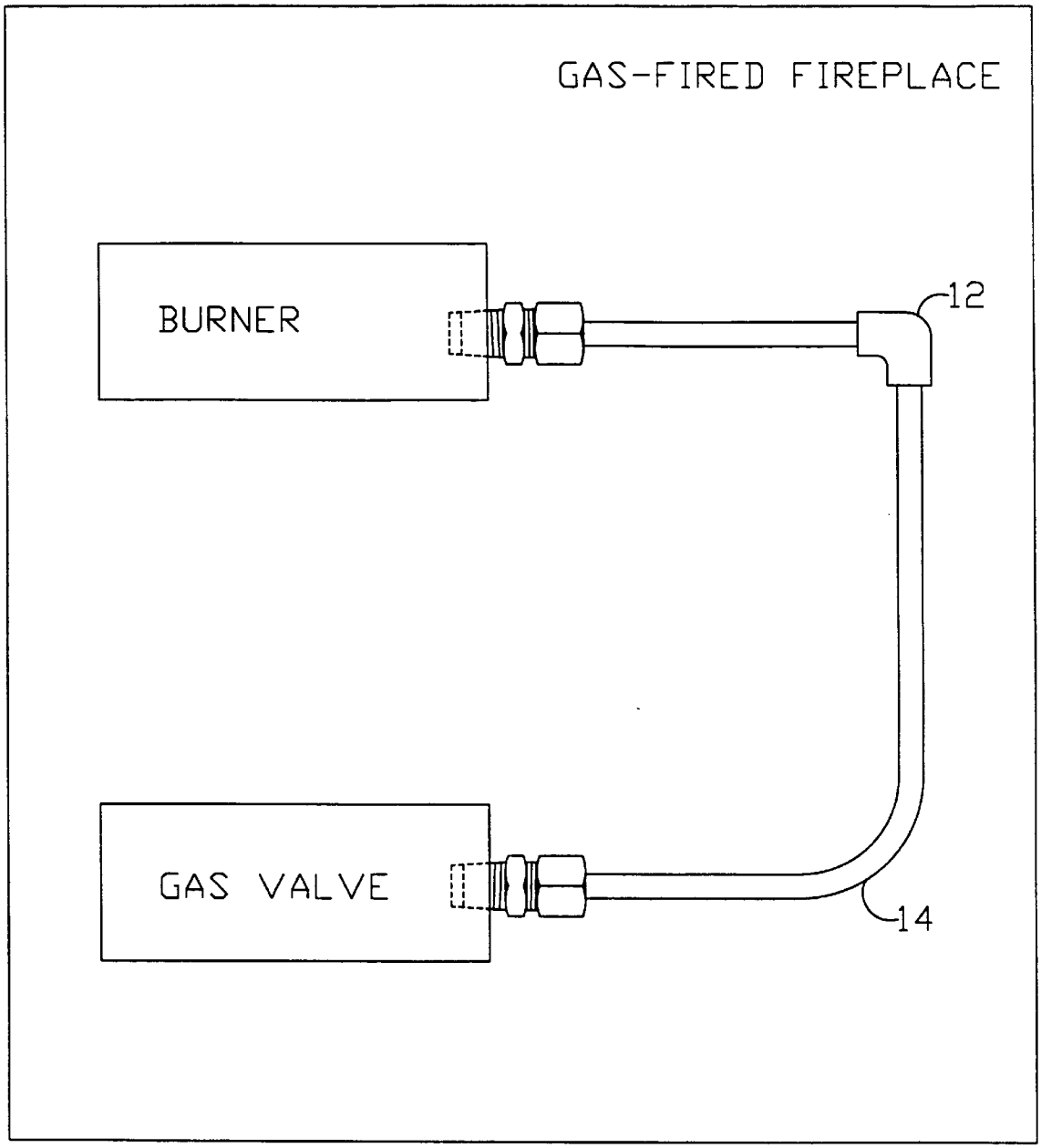
PRIOR ART FIG. 1a.
FIG. 1*a* is a diagram of a prior art fuel tube assembly for the gas-fired appliance.
Figure 2:
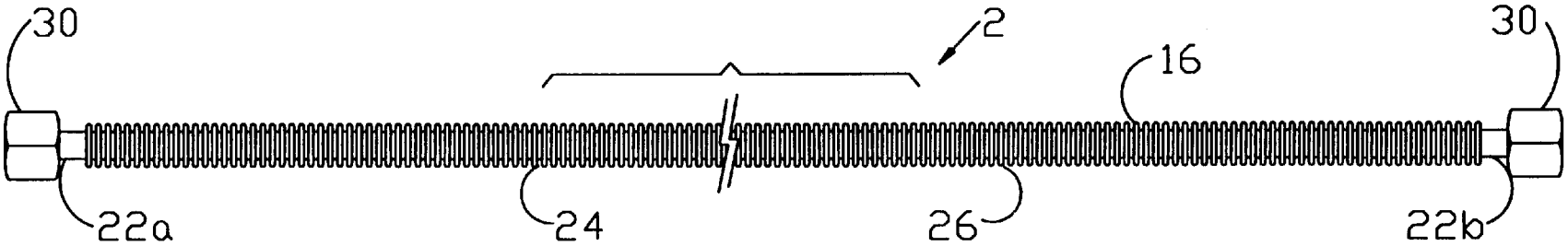
FIG. 2 is a side elevational view of a short-neck version of the tube assembly, shown in a straight configuration thereof.

FIG. 1*a* shows a prior art fuel line installation with a 90° elbow 12 connecting a prior art fuel line 14 to the burner inlet port 10*a*. A typical prior art fuel line 14 consists of ridid aluminum tubing or conduit which has been bent to the configuration required to align with the gas ports 6*a*, 10*a*.

The tube assembly 2 generally consists of a tube 16 mounting first and second compression fitting subassemblies 18*a,b*.

II. Tube 16

The tube 16 includes first and second ends 20*a,b* located adjacent to first and second tube end sections 22*a,b* respectively whereat the tube 16 has a relatively straight, smooth-walled configuration. A corrugated tube medial section 24 extends between the tube end sections 22*a,b* and includes a plurality of corrugations 26. The tube medial section 24 can be provided with either helical or annular corrugations, both of which can be produced on conventional tube-forming equipment. Without limitation on the generality of useful materials for the tube 16, it can comprise, for example, stainless steel which has sufficient flexibility to accommodate bends and turns, and is also resistant to rust and corrosion.

III. Compression Flitting Subassemblies 18

Each compression fitting subassembly 18*a,b* includes a compression fitting nut 28 with a bore 30 slidably and rotatably receiving a respective tube end section 22*a,b* and an outwardly-open, female-threaded counterbore 32. A compression fitting ferrule 34 includes a stem 36 which slidably and rotatably receives a respective tube end section 22*a,b* and is received in the bore 30. The ferrule 34 also includes a head 38 mounted on and positioned outwardly from the stem 36. The head 38 is outwardly-converging and generally frusto-conical in configuration, with a frustoconical engagement face 40 encircling same.

A compression fitting body 42 includes a straight male-threaded inner end 44*a*, a tapered male-threaded outer end 44*b* and a hexagonal medial portion 46. The inner end 44*a* is threadably received in the nut counterbore 32 whereby the ferrule 34 is threadably clamped into engagement within the body 42 and the ferrule engagement face 40 forms a seal within the body 42.

Compression fittings such as those designated 18*a,b* and described above are in common usage for forming plumbing connections in gas and water lines. An advantage of a compression fitting such as those designated 18*a,b* is that the fitting nut 28 and the body 42 can be tightened independently of each other. Thus, a normal assembly sequence would involve threadably tightening the tapered male-threaded body outer ends 44*b* in the female-threaded ports 6*a*, 10*a*. The tube end sections 22*a,b* can then be inserted in the nuts 28, the ferrules 34 placed on the tube end sections 22*a,b*, the ferrules 34 and the tube end sections 22*a,b* can then be inserted into the body inner ends 44*a* and the compression fitting nuts 28 can be tightened on the straight male-threaded body inner ends 44*a*.

IV. Installation and Operation.

The tube assembly 2 can be installed as original equipment in the gas appliance 4, or can be retrofit to replace an existing application such as the 90° elbow 12 and the fuel line 14 identified herein as prior art. Such a replacement commonly occurs when the gas-fired appliance is being serviced, for example, in connection with changing the valve 6, the burner 10 or a flow regulator (not shown).

Installation is accomplished by removing the existing fuel line (e.g. fuel line 14) and the prior art 90° elbow 12 from the valve 6 and the burner 10. The corrugated medial section 24 of the tube 16 accommodates bending to a desired configuration, such as the 180° bend 48 shown, which can comprise two 90° subbends 50. Such bending can typically be accomplished in the field, with the corrugated medial section 24 facilitating alignment of the tube ends 20*a,b* with the valve and burner ports 6*a*, 10*a*.

By employing the tube assembly 2, the prior art 90° elbow 12 can be eliminated from the installation, thus saving labor and materials. Still further, different orientations of ports can be accommodated since the corrugated medial section can be bent through a wide variety of different combinations and degrees of bends and turns. Still further, corrugations 26 accommodate a certain amount of linear expansion and contraction in the event the tube assembly 2 needs to be stretched or compressed to form a particular connection. Installation in a number of different appliances with different spacings and orientations of the ports 6*a*, 10*a* to be connected is facilitated with the tube assembly 2 because a single size of the tube assembly 2 can be formed to accommodate a wide variety of port spacings and orientations.

IV. First Modified Embodiment Tube Assembly 102.

Figure 4:
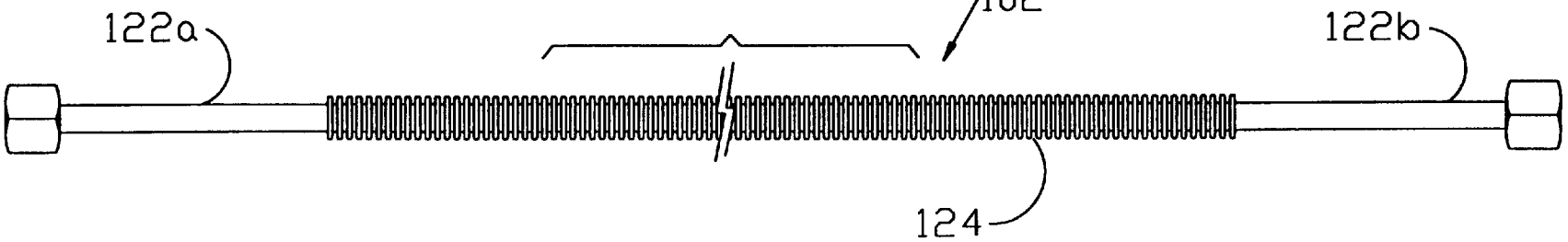
FIG. 4 is a side elevational view of a long-neck tube assembly comprising a first modified embodiment of the present invention.
Figure 3:
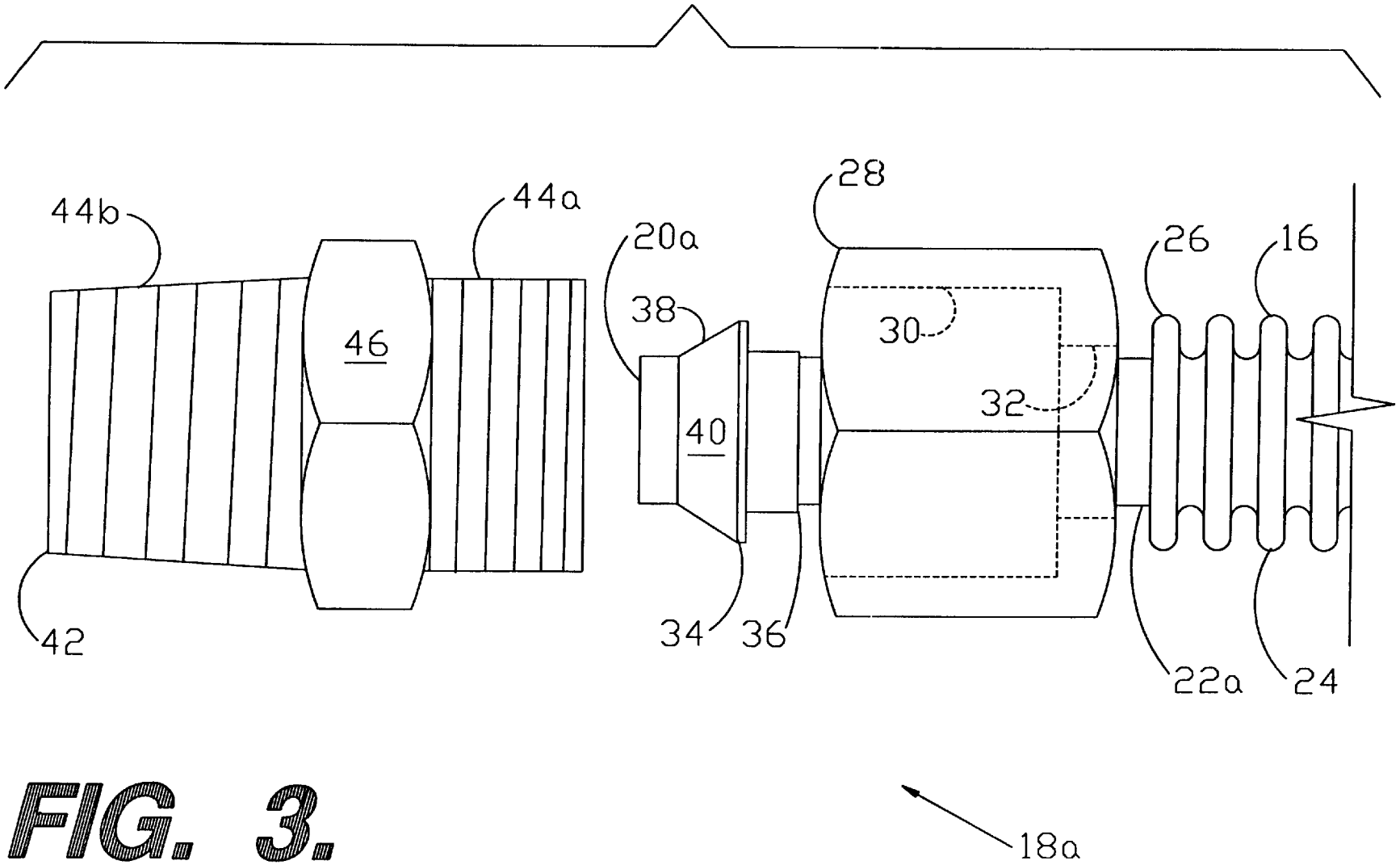
FIG. 3 is an exploded, side elevational view of the tube assembly, particularly showing a compression fitting subassembly thereof partially exploded.

FIG. 4 shows a tube assembly 102 comprising a first modified embodiment of the present invention and including first and second lengthened end sections 122*a,b* with a corrugated medial section 124 located therebetween. The lengthened end sections 122*a,b* may be desirable for use in conjunction with certain applications where longer straight runs are desired in proximity to the tube assembly ends and where shorter lengths of the medial sections are required for forming the gas flow path bends and turns.

It is to be understood that while certain forms of the present invention have been illustrated and described herein, it is not to be limited to the specific forms or arrangement of parts described and shown.

What is claimed and desired to be secured by Letters Patent is as follows:

1. A flexible fuel tube assembly for a gas-fired appliance with a valve having a gas outlet port and a burner having a gas inlet port, which tube assembly comprises:

a) a tube with first and second end sections terminating at first and second ends respectively;

b) said tube having a corrugated flexible medial section extending between and fluidically connected to said end sections;

c) said tube having a bore extending between said tube ends;

d) first and second compression fitting subassemblies mounted on said first and second tube ends respectively and fludically connecting same with said appliance valve and said appliance burner respectively, each said compression fitting subassembly including:

(1) a compression fitting ferrule longitudinally slidably mounted on a respective tube end section, (2) said ferrule including an outwardly-converging, frusto-conical engagement face;

(3) a compression fitting nut with a bore rotatably receiving a respective tube end section and a female-threaded counterbore extending outwardly from said compression fitting nut bore, said counterbore rotatably receiving said ferrule;

(4) said ferrule including a ferrule shaft rotatably received in said nut bore and a ferrule head including said ferrule engagement face, said ferrule head being rotatably received in said nut counterbore;

(5) a compression fitting body including inner and outer male-threaded ends, a compression fitting body bore extending between and open at said ends and a compression fitting body counterbore extending from said inner end into said compression fitting body and including a body engagement face adapted for sealingly engaging said ferrule engagement face;

(6) said inner end of said compression fitting body being threadably received in said compression fitting nut counterbore;

(7) said outer threaded end of said compression fitting body of said first compression fitting subassembly being threadably received in said valve outlet port; and (8) said outer threaded end of said compression fitting body of said second compression fitting subassembly being threadably received in said burner inlet port.

2. The tube assembly according to claim 1 which includes:

a) said tube assembly ends being oriented in approximately the same direction in parallel, spaced relation from each other.

3. The tube assembly according to claim 2, which includes:

a) said tube assembly medial section including a bend of approximately 180°.

4. The tube assembly according to claim 3, wherein said tube medial section bend comprises two subbends of approximately 90° each.

5. In combination with a gas fireplace including a gas valve with a female-threaded gas outlet port and a burner with a female-threaded gas inlet port, the improvement of a flexible fuel tube assembly, which comprises:

a) a tube with first and second end sections terminating at first and second ends respectively;

b) said tube having a corrugated flexible medial section extending between and fluidically connected to said end sections;

c) said tube having a bore extending between said tube ends;

d) first and second compression fitting subassemblies mounted on said first and second tube ends respectively and fluidically connecting same with said appliance valve and said appliance burner respectively, each said compression fitting subassembly including:

(1) a compression fitting ferrule longitudinally slidably mounted on a respective tube end section, (2) said ferrule including an outwardly-converging, frusto-conical engagement face;

(3) a compression fitting nut with a bore rotatably receiving a respective tube end section and a female-threaded counterbore extending outwardly from said compression fitting nut bore, said counterbore rotatably receiving said ferrule;

(4) said ferrule including a ferrule shaft rotatably received in said nut bore and a ferrule head including said ferrule engagement face, said ferrule head being rotatably received in said nut counterbore;

(5) a compression fitting body including inner and outer male-threaded ends, a compression fitting body bore extending between and open at said ends and a compression fitting body counterbore extending from said inner end into said compression fitting body and including a body engagement face adapted for sealingly engaging said ferrule engagement face;

(6) said inner end of said compression fitting body being threadably received in said compression fitting nut counterbore;

(7) said outer end of said compression fitting body of said first compression fitting subassembly being threadably received in said valve outlet port; and (8) said outer threaded end of said compression fitting body of said second compression fitting subassembly being threadably received in said burner inlet port.

6. A method of retrofitting a new fuel tube assembly in a gas fireplace having a gas valve with a female-threaded gas outlet port, an existing fuel tube extending from the gas valve outlet port, an elbow connected to the fuel tube and a burner with a female-threaded gas inlet port connected to said elbow, which comprises the steps of:

a) removing said existing fuel tube;

b) removing said elbow;

c) providing a tube with opposite, rigid, smooth-walled end sections and a corrugated medial section;

d) connecting said first end section to said gas valve outlet port with a compression fitting subassembly;

e) bending said tube medial portion through a gas flow path of approximately 180°; and f) connecting said second end section to said burner inlet port with a compression fitting subassembly.

* * * * *